US010822893B2

(12) United States Patent
Zimbelmann et al.

(10) Patent No.: US 10,822,893 B2
(45) **Date of Patent: *Nov. 3, 2020**

(54) APPARATUS AND METHODS FOR TONG OPERATION

(71) Applicant: Weatherford Technology Holdings, LLC, Houston, TX (US)

(72) Inventors: Georg Zimbelmann, Lehrte (DE); Ditmar Clasen, Hannover (DE); Bjoern Thiemann, Burgwedel (DE)

(73) Assignee: Weatherford Technology Holdings, LLC, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/678,519

(22) Filed: Nov. 8, 2019

(65) Prior Publication Data

US 2020/0072002 A1 Mar. 5, 2020

Related U.S. Application Data

(63) Continuation of application No. 15/682,427, filed on Aug. 21, 2017, now Pat. No. 10,472,906.

(51) Int. Cl.
*E21B 19/16* (2006.01)

(52) U.S. Cl.
CPC ..... *E21B 19/165* (2013.01); *E21B 19/16* (2013.01); *E21B 19/161* (2013.01); (Continued)

(58) Field of Classification Search
CPC ..... E21B 19/10; E21B 19/16; E21B 19/161; E21B 19/162; E21B 19/163; E21B 19/164; E21B 19/165; E21B 19/166
See application file for complete search history.

(56) References Cited

U.S. PATENT DOCUMENTS 5,049,020 A * 9/1991 McArthur ..... E21B 19/14 175/85
5,988,299 A 11/1999 Hansen et al.
(Continued)

FOREIGN PATENT DOCUMENTS

GB 2160807 A 1/1986

OTHER PUBLICATIONS

International Search Report and Written Opinion in application PCT/US2018/046736 dated Oct. 29, 2018.
(Continued)

*Primary Examiner* — Tara Schimpf
(74) *Attorney, Agent, or Firm* — Patterson + Sheridan, LLP

(57) ABSTRACT

A tong includes a frame having jaws configured to engage a tubular and a tong control assembly disposed on the frame. The tong control assembly includes a housing connected to the frame, a shutoff switch, and a toggle lever located at a suitable position on the housing, whereby the toggle lever is configured to be operated while the shutoff switch is depressed, and wherein the toggle lever is configured to control at least one of: a rotational speed of the jaws and a rotational direction of the jaws. A method of operating a tong includes clamping a first tubular using first jaws of a tong, clamping a second tubular using second jaws of the tong, rotating the first tubular relative to the second tubular, and controlling a rotational speed of the first tubular using a toggle lever disposed on a frame of the tong.

22 Claims, 7 Drawing Sheets

(52) U.S. Cl.
CPC ..... *E21B 19/162* (2013.01); *E21B 19/163* (2013.01); *E21B 19/164* (2013.01); *E21B 19/166* (2013.01)

(56) References Cited

U.S. PATENT DOCUMENTS

| | | | | |
|---|---|---|---|---|
| 6,119,557 | A | 9/2000 | Penisson | |
| 8,733,213 | B2 | 5/2014 | Taggart | |
| 2002/0178871 | A1 | 12/2002 | Hauk et al. | |
| 2008/0011470 | A1 | 1/2008 | Hobgood | |
| 2013/0255446 | A1* | 10/2013 | Taggart | E21B 19/161 81/57.11 |
| 2015/0107850 | A1 | 4/2015 | Mosing et al. | |
| 2016/0076356 | A1 | 3/2016 | Krems et al. | |

OTHER PUBLICATIONS

International Preliminary Report on Patentability in application PCT/US2018/046736 dated Feb. 25, 2020.
Extended European Search Report in related application EP 20179556.4 dated Sep. 1, 2020.

* cited by examiner

APPARATUS AND METHODS FOR TONG OPERATION

CROSS-REFERENCE TO RELATED APPLICATIONS

This application is a Continuation of application Ser. No. 15/682,427 filed on Aug. 21, 2017, which is herein incorporated by reference.

BACKGROUND

Field of the Invention

Embodiments of the present invention generally relate to apparatus and methods for operating a tong.

Description of the Related Art

Construction of oil or gas wells usually requires making long tubular strings that make up casing, risers, drill pipe, or other tubing. Due to the length of these strings, sections or joints of tubulars are progressively added to or removed from the tubular strings as they are lowered or raised from a drilling platform. Tongs are devices used on oil and gas rigs for gripping and/or rotating tubular members, such as casing, drill pipe, drill collars, and coiled tubing (herein referred to collectively as tubulars and/or tubular strings). Tongs may be used to make-up or break-out threaded joints between tubulars. Tongs typically resemble large wrenches, and may sometimes be referred to as power tongs, torque wrenches, spinning wrenches, and/or iron roughnecks. Tongs typically use hydraulic power to provide sufficiently high torque to make-up or break-out threaded joints between tubulars.

Historically, tongs have been either manually operated or controlled remotely by an operator in the driller's cabin. Onboard tong control has heretofore not been achievable due to control system size, power, and safety requirements.

Onboard control of a tong may provide improved handling, greater reliability, and increased safety and efficiency.

SUMMARY OF THE INVENTION

Embodiments of the present invention generally relate to apparatus and methods for operating a tong.

A tong includes a frame having jaws configured to engage a tubular and a tong control assembly disposed on the frame. The tong control assembly includes a toggle lever configured to control a rotational speed of the jaws.

A tong includes a frame having jaws configured to engage a tubular and a tong control assembly disposed on the frame. The tong control assembly includes a housing connected to the frame, a handle connected to the housing, and a toggle lever configured to control a rotational speed of the jaws. The toggle lever is located at a suitable position on the housing, whereby the toggle lever is configured to be operated while the shutoff switch is depressed.

A tong includes a frame having jaws configured to engage a tubular, a tong control assembly disposed on the frame. The tong control assembly includes a housing connected to the frame, a shutoff switch, and a toggle lever located at a suitable position on the housing, whereby the toggle lever is configured to be operated while the shutoff switch is depressed, and wherein the toggle lever is configured to control at least one of: a rotational speed of the jaws and a rotational direction of the jaws.

A tong includes a frame having jaws configured to engage a tubular, a tong control assembly disposed on the frame including a housing connected to the frame, a handle connected to the housing, and a toggle lever configured to control a rotational speed and a rotational direction of the jaws.

A method for operating a tong includes clamping a first tubular using first jaws of the tong, clamping a second tubular using second jaws of the tong, rotating the first tubular relative to the second tubular, controlling a rotational speed of the first tubular using a toggle lever disposed on a frame of the tong.

A method includes installing a tong control assembly on a frame having jaws configured to engage a tubular, the tong control assembly including a toggle lever and controlling a rotational speed of the jaws using the toggle lever.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only typical embodiments of this disclosure and are therefore not to be considered limiting of its scope, for the disclosure may admit to other equally effective embodiments.

DETAILED DESCRIPTION

Embodiments of the present invention generally relate to apparatus and methods for operating a tong.

In some embodiments, a tong control system may be small (e.g., less than about 2 feet in any dimension; for example 16" by 16" by 6"), so that it can be placed on the tong. Consequently, existing tongs may be beneficially retrofitted.

A tong control system may monitor and actuate several parts of the tong. For example, the tong control system may monitor and actuate components of the tong to provide varying torque and/or angular displacement. Disconnection of a tubular joint may require both a high-torque/low-angular displacement "break" action to disengage the contact shoulders, and a low-torque/high-angular displacement "spin" action to screw-out the threads. Connection of a tubular joint may occur in the reverse sequence. In the make/break action, torque may be high (e.g., 10,000-100,000 ft-lbf), having a small (e.g., 0.12-0.24 revolutions) angular displacement. In the spin action, torque may be low (e.g., 1,000-3,000 ft-lbf), having a large (e.g., 3-5 revolutions) angular displacement.

As another example, the tong control system may monitor and actuate components of the tong to provide varying clamping and rotation actions. Upper and lower jaws of the tong may turn relative to each other to break a connection between upper and lower tool joints. The upper jaw may then be released while the lower jaw remains clamped onto the lower tool joint. A spinning wrench, commonly separate from the torque wrench and mounted higher up on the carriage, may engage the stem of the upper joint of drill pipe to spin the upper joint until it is disconnected from the lower joint. Upper and lower jaws of the tong may turn relative to each other to make-up two joints of pipe. The lower jaw may grip the lower tool joint while the upper pipe is brought into position. The spinning wrench may engage the upper joint to spin it into the lower joint. The torque wrench may clamp the pipe and tighten the connection.

Figure 1:
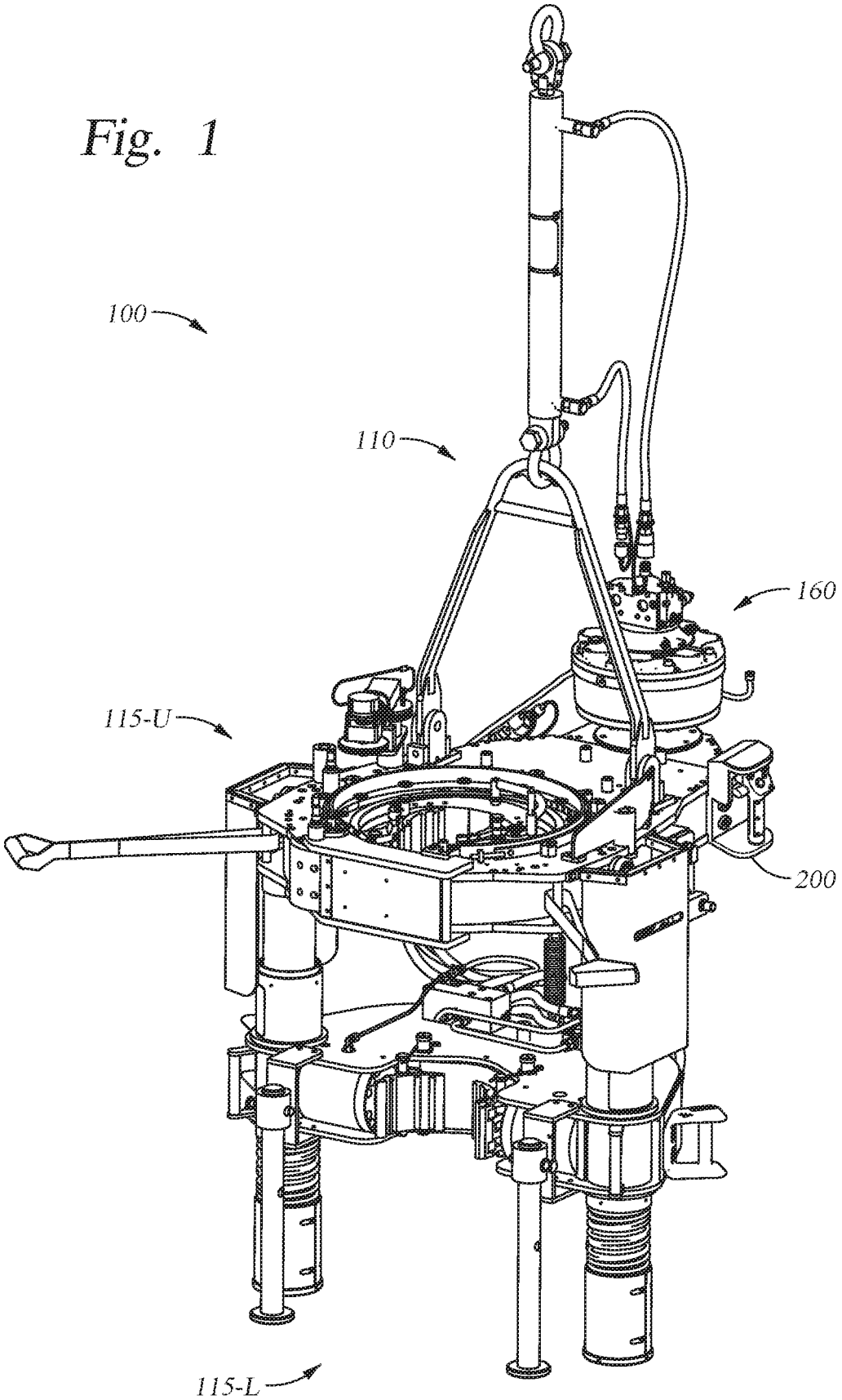
FIG. 1 illustrates an exemplary tong according to embodiments described herein.

FIG. 1 illustrates an exemplary tong 100. The tong 100 may include a frame 110. The frame 110 may include a plurality of jaws 115, for example a first or upper jaws 115-U and a second or lower jaws 115-L. The jaws may be configured to grip and/or rotate tubulars. The jaws (or portions thereof) may move (e.g., rotate) relative to the frame 110. Consequently, the jaws 115 may be referred to as a rotating portion of the tong 100, and the frame 110 may be referred to as a stationary portion of the tong 100. In some embodiments, the tong 100 may include a control system 160 for tong control. The tong 100 may also include electrical equipment (e.g., actuators, sensors). The tong 100 may include a tong control assembly 200. In some embodiments, the control system 160 and the tong control assembly 200 may be disposed on a stationary portion of the tong 100, for example the frame 110. The tong 100 may also include manual levers for manually controlling operation of the tong 100 and the plurality of jaws. The levers may be disposed on a stationary portion of the tong 100, for example the frame 110. The tong control assembly 200 may be configured to operate other tong embodiments. An exemplary tong is disclosed in U.S. Patent Application Publication No. 2004/0237726, which is hereby fully incorporated by reference.

In some embodiments, tong control system 160 may be configured to control how the tong 100 handles tubulars, grips tubulars, turns tubulars, and/or manages hydraulic power for handling, gripping, and/or turning tubulars. In some embodiments, tong control system 160 may be configured to receive input (e.g., from sensors) regarding how the tong 100 interacts with tubulars. In some embodiments, tong control system 160 may be configured to process and/or store data (e.g., pipe size, thread size, thread count, etc.) regarding how the tong 100 interacts with tubulars. In some embodiments, tong control system 160 may be configured to generate and/or send control signals to control how the tong 100 interacts with tubulars. Tong control system 160 may include a torque sensor (e.g., a load cell) and/or a turns counter. In some embodiments, tong control system 160 may be configured to also receive input from a clock. Tong control system 160 may include data storage and/or data processors. Tong control system 160 may include a tubular gripping actuator, a tubular turning actuator, and/or a hydraulic power control actuator (e.g., a dump valve). In some embodiments, tong control system 160 may be configured to send control signals to a tubular gripping actuator, a tubular turning actuator, and/or a hydraulic power control actuator. In some embodiments, tong control system 160 may be configured to also send control signals to a jaw positioning actuator.

Figure 2:
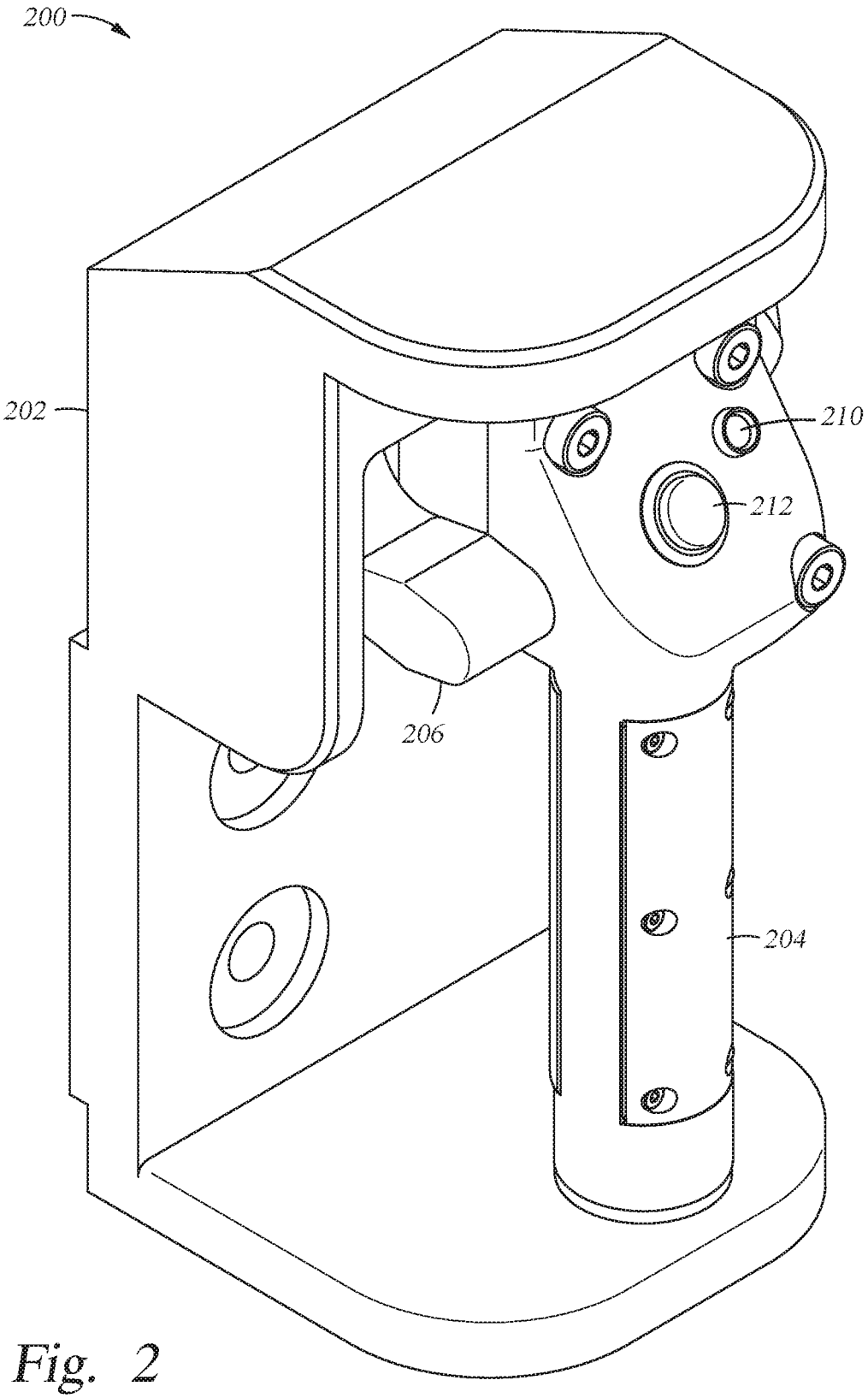
FIG. 2 illustrates an isometric view of an exemplary tong control assembly for the tong of FIG. 1.
Figure 3A:
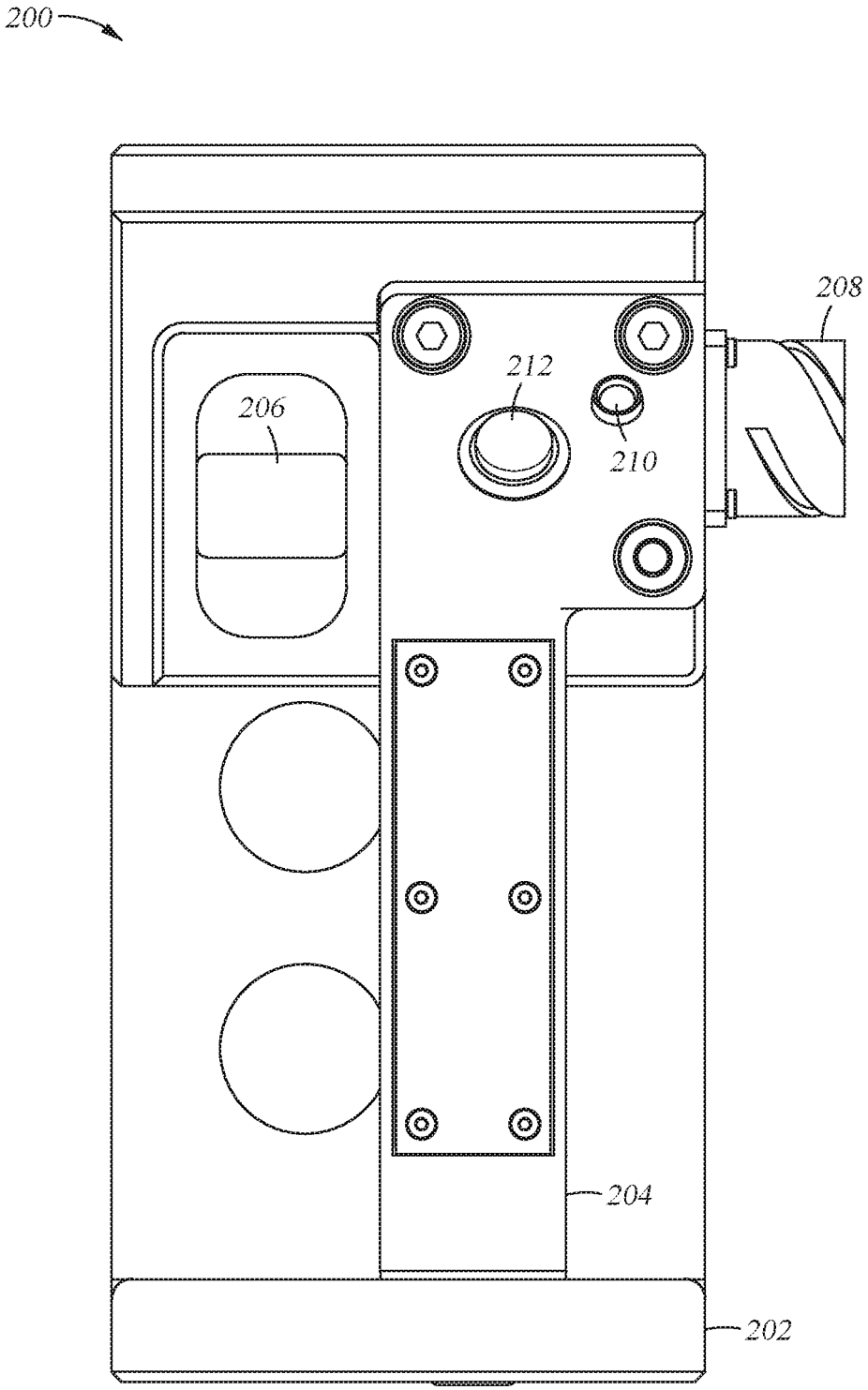
FIG. 3A illustrates a front view of the exemplary tong control assembly of FIG. 2.
Figure 3B:
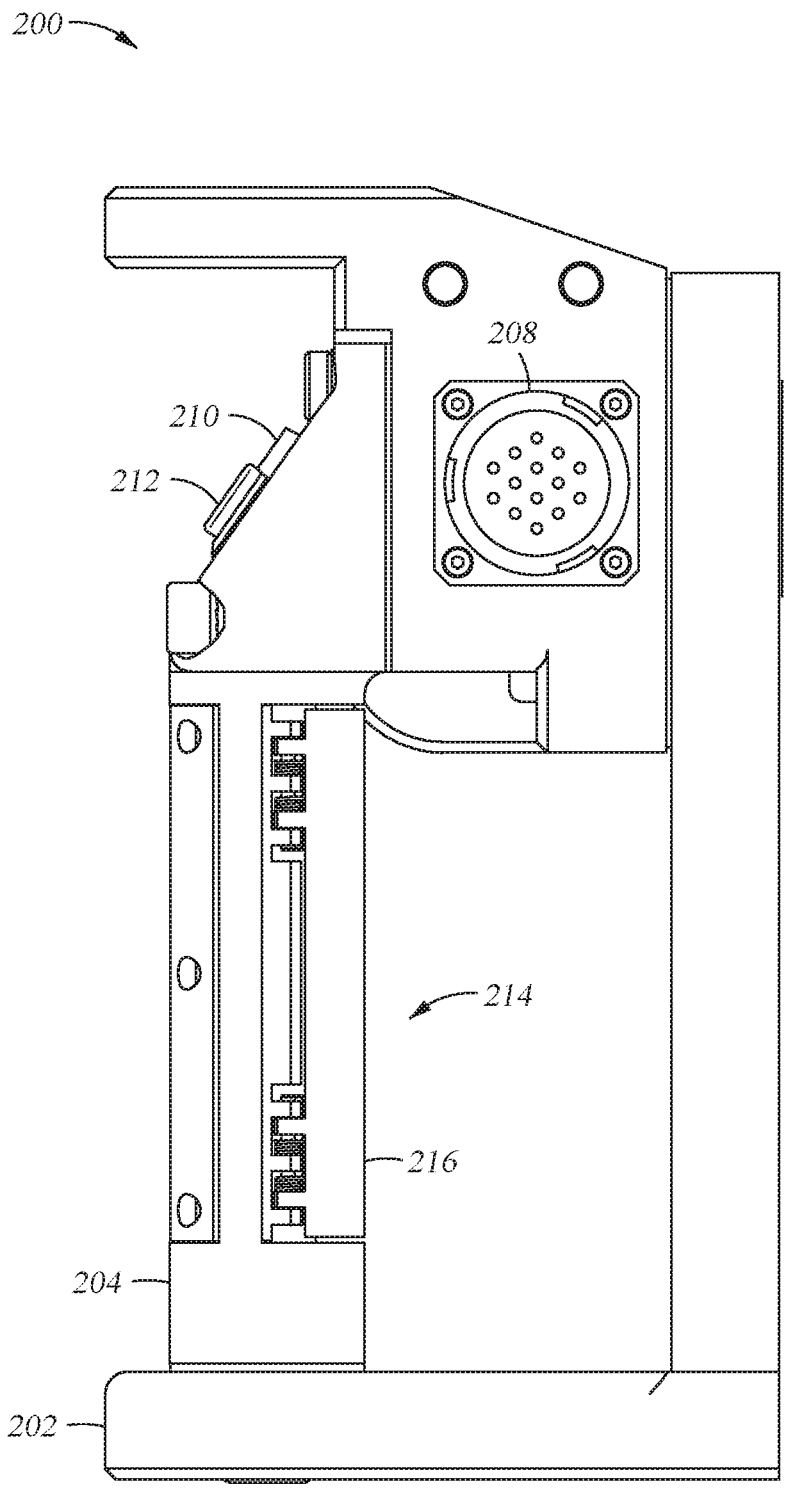
FIG. 3B illustrates a side view of the exemplary tong control assembly of FIG. 2.
Figure 3C:
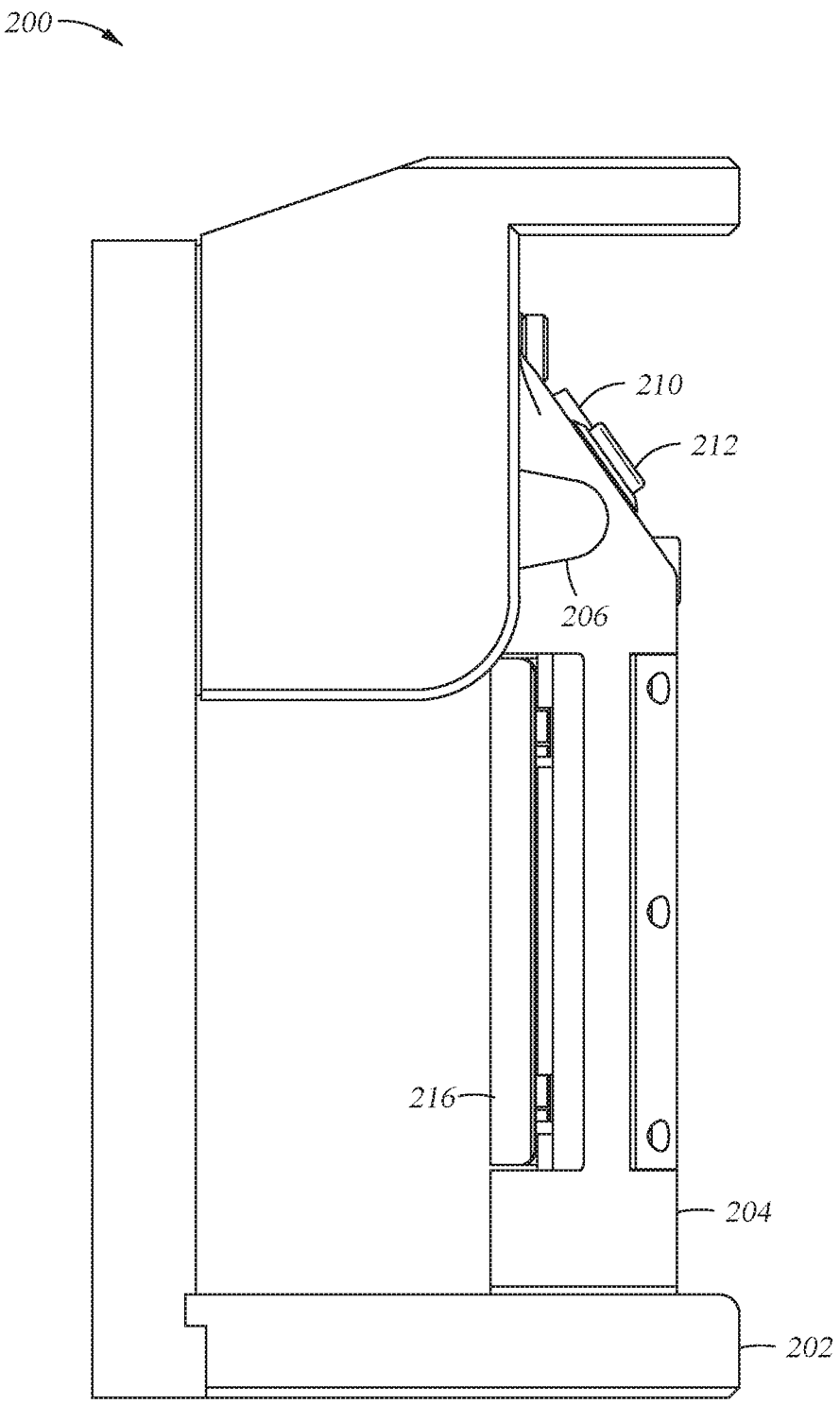
FIG. 3C illustrates an opposite side view of the exemplary tong control assembly of FIG. 2.

FIGS. 2-3C illustrate the tong control assembly 200. In some embodiments, the tong control assembly 200 may be configured to manually control operation of the tong 100. In some embodiments, the tong control assembly 200 may be configured to send control signals to the control system 160 for operation of the tong 100. In one embodiment, the tong control assembly may include a housing 202, a handle 204, a toggle lever 206, electrical connector 208, an indicator light 210, and a push-button control 212. The housing 202 may be connected to the frame 110 of the tong 100. The housing 202 may be rectangular in shape. The housing 202 may have an inner recessed portion. The housing 202 may have a lower shoulder and an upper shoulder. The inner recessed portion of the housing 202 may be disposed longitudinally between the upper and lower shoulders. The handle 204 may be at least partially disposed in the inner recessed portion. The handle 204 may be connected to the housing 202, for example by fasteners. Alternatively, the handle 204 may be integrally formed with the housing 202.

The toggle lever 206 may be at least partially disposed in the inner recessed portion of the housing 202. The toggle lever 206 may be biased to a neutral position, as shown in FIG. 2. The toggle lever 206 may be configured to control the rotational speed of the tong 100, for example the upper jaws 115-U. The toggle lever 206 may be pivotally connected to the housing 202. The toggle lever 206 may be pivotally movable. The toggle lever 206 may be configured to control a rotational direction of the tong 100, for example the upper jaws 115-U. For example, the toggle lever 206 may be configured to rotate the upper jaws 115-U in a first direction during make-up of a connection between a tubular and a tubular string. The toggle lever 206 may be configured to rotate the jaws 115-U in a second direction during break-out of a tubular and a tubular string. The toggle lever 206 may be configured to rotate the upper jaws 115-U bi-directionally. For example, the toggle lever 206 may be configured to rotate the jaws 115-U clockwise and counter-clockwise. The toggle lever 206 may pivot in a vertical plane. The toggle lever 206 may be movable to control the rotational speed of the jaws 115-U during at least a portion of make-up and/or break-out of a tubular connection. In some embodiments, the toggle lever 206 may be movable through a continuous range of positions corresponding to rotational speeds of the jaws 115-U. The toggle lever 206 may be configured to control a continuous range of rotational speeds of the jaws 115-U. For example, the toggle lever 206 may be pivotally movable from the neutral position to a maximum position corresponding to a maximum rotational speed input into the control system 160. In some embodiments, the toggle lever 206 may be movable through set positions corresponding to rotational speeds of the jaws 115-U. The toggle lever 206 may be configured to rotate a rotor of the upper jaws 115-U. The toggle lever 206 may be movable in a first direction during the make-up operation of the tong 100. The toggle lever 206 may be movable in a second direction during the break-out operation of the tong 100. For example, the toggle lever 206 may be pivotable in an upward direction during make-up operations. The toggle lever 206 may be pivotable in a downward direction during break-out operations. In some embodiments, the toggle lever 206 may be located at any suitable position on the housing 202 whereby the operator may operate the toggle lever 206 while grasping the handle 204. In some embodiments, the toggle lever 206 may be located at a position on the housing 202 whereby the operator may operate the toggle lever 206 with the same hand used to grasp the handle 204. In some embodiments, the toggle lever 206 may be located at a position on the housing 202 whereby the operator may operate the toggle lever 206 while a shutoff switch 214 is depressed. The toggle lever 206 may be configured to control a rotational speed and a rotational direction of a tubular engaged by the jaws. In some embodiments, the toggle lever 206 may be located in the inner recessed region of the housing 202 behind the handle 204. In some embodiments, the toggle lever may include a hook-shaped portion. The operator may place a finger in the hook-shaped portion to operate the toggle lever. In some embodiments, the toggle lever may be disposed on the handle 204. The toggle lever may be a push-button. The push-button may be movable through a continuous range of positions corresponding to rotational speeds of the jaws. The push-button may be disposed on an inward facing surface of the handle 204.

The electrical connector 208 may be configured to connect to an electrical cable. The electrical connector 208 may be disposed on a wall of the housing 202. The electrical connector 208 may face outwardly of the housing 202. An opposite end of the electrical cable may be connected to the tong control system 160. The electrical cable may transfer signals between the tong control assembly 200 to the tong control system 160. The indicator light 210 may be configured to indicate an operational mode of the tong 100. The indicator light 210 may be disposed on the handle 204. The indicator light 210 may be a light emitting diode. The indicator light 210 may alternate between off, blinking, and steady-on to indicate the current mode of the tong 100. The push-button control 212 may be disposed on the handle 204. The push-button control 212 may be located at any suitable position on the handle 204 whereby the operator may depress the push-button control while grasping the handle 204. In some embodiments, the push-button control 212 may be located at a position on the handle 204 whereby the operator can depress the push-button control with the same hand used to grasp the handle 204. In some embodiments, the push-button control 212 can be used to control the tong 100. In some embodiments, the push-button control 212 can be used to initiate an automatic make-up sequence of the tong 100. The indicator light 210 may be configured to blink to indicate the tong 100 is ready to enter the automatic make-up sequence.

FIG. 3B illustrates a dead man or shutoff switch 214 of the tong control assembly 200. The dead man switch 214 may be disposed on the handle 204. The dead man switch 214 may be integrally formed with the handle 204. The dead man switch 214 may include an actuation plate 216. The actuation plate 216 may be a cylindrical shell. The actuation plate 216 may be disposed on an inner facing portion of the handle 204. In some embodiments, the tong control assembly 200 may be configured to work only when the dead man switch 214 is squeezed and held.

Figure 4A:
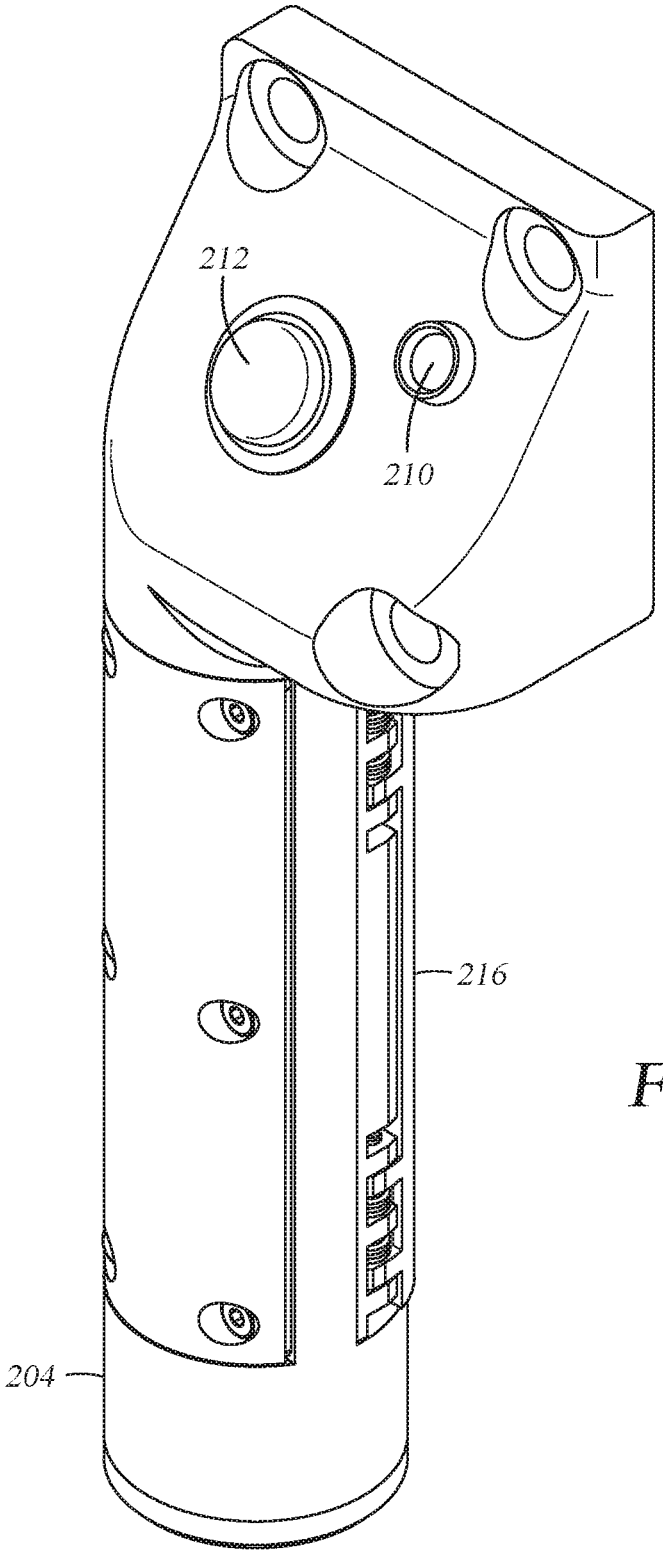
FIG. 4A illustrates an isometric view of a handle of the exemplary tong control assembly.
Figure 4B:
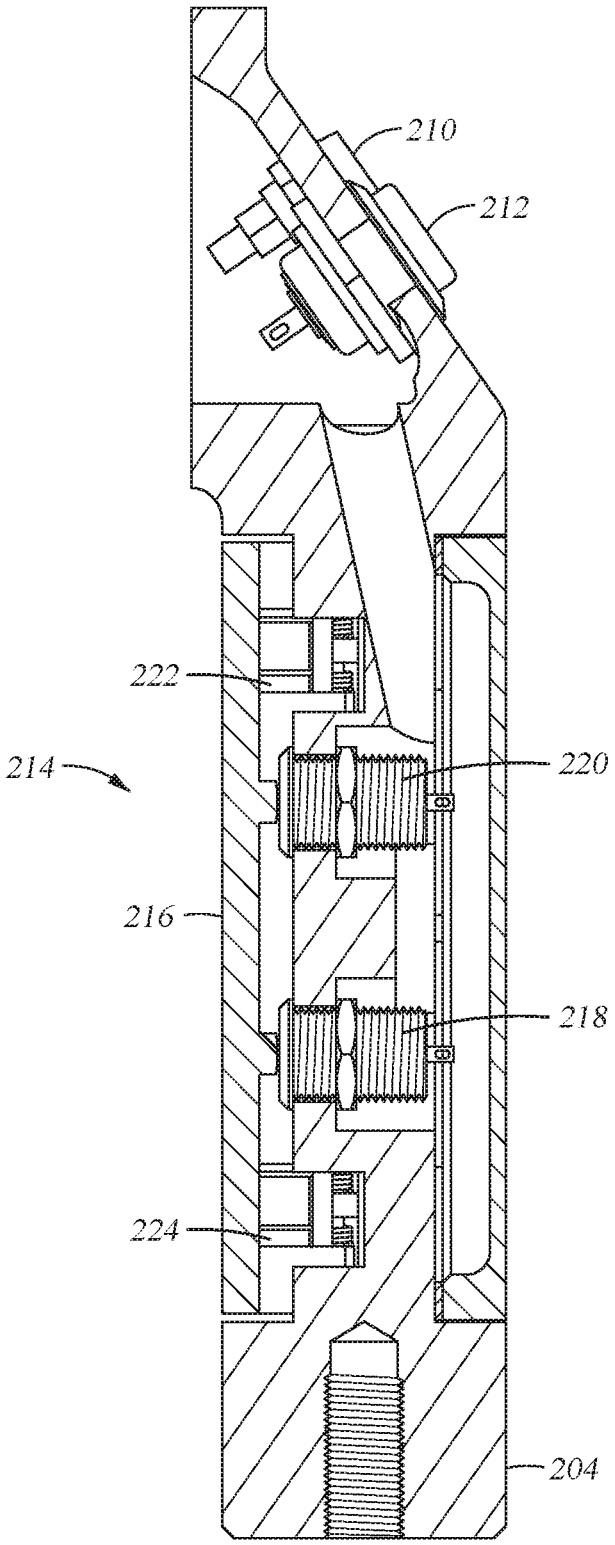
FIG. 4B illustrates a cross-sectional view of the handle of FIG. 4A.

FIGS. 4A and 4B illustrate the handle 204 of the tong control assembly 200. The dead man switch 214 may also include push-buttons 218, 220 and one or more biasing members, such as springs 222, 224. The actuation plate 216 may include tabs disposed on an inner surface thereof. The tabs of the actuation plate 216 may be configured to engage and depress the corresponding push-buttons 218, 220 when the dead man switch 214 is squeezed and held. The springs 222, 224 may be configured to bias the actuation plate 216 outward and the tabs out of engagement with the corresponding push-buttons 218, 220. The springs 222, 224 may bias the dead man switch 214 to a neutral position where the push-buttons 218, 220 are not depressed and the tong 100 therefore is prevented from operation.

Before makeup begins, the operator may manually enter the size, material, and thread type of the pipe. The operator may also enter a set torque, the maximum torque, and/or maximum rotational speed of the pipe. In the alternative, the control system 160 may calculate a set torque, final torque, final turns, and/or maximum rotational speed of the pipe based on the size, material, and thread type of the pipe. The set torque may correspond to a torque at which the automatic make-up sequence of the tong 100 may be initiated.

In some embodiments, the tong 100 may be operated to add tubulars to a tubular string by the following steps. An operator may grasp the tong 100 by the handle 204. The handle 204 may be configured to allow the operator to move the tong 100 adjacent a string of tubulars being added to. The operator may move the tong 100 adjacent the string of tubulars. The dead man switch 214 may be grasped and held in order to allow for operation of the tong 100 and use of the tong control assembly 200. The toggle lever 206 may be operated to align a recess in the upper jaws 115-U (the jaws may already be in this configuration following the removal of the tong 100 from a previous section of tubing) with an opening at the front of the upper jaws 115-U. The toggle lever 206 may send a signal to the control system 160 to rotate the rotor of the jaws 115-U including the recess. The operator may control the speed at which the rotor rotates using the toggle lever 206. The recess of the rotor may be aligned with the opening at the front of the jaws 115-U to allow tubulars to be inserted into the tong 100. Two tubulars are then introduced into the openings in the upper and lower jaws through the recesses and the lower tubular is clamped in position in the lower jaws 115-L.

Next, the toggle lever 206 may be operated to clamp the upper tubular in position in the upper jaws 115-U. The toggle lever 206 may send a signal to the control system 160 to rotate the rotor. The operator may control the speed at which the rotor rotates using the toggle lever 206. The operator may lower the speed at which the rotor rotates by moving the toggle lever 206 closer to the neutral position, shown in FIG. 2. The operator may increase the speed at which the rotor rotates by moving the toggle lever 206 further from the neutral position. Rotation of the rotor may cause gripping members of the upper jaws 115-U to cam inward and grip the tubular. The tong 100 may then be operated to add the tubular to the tubular string. The operator may continue to operate the tong 100 using the toggle lever 206. The toggle lever 206 may control the rotational speed of the tubular relative to the tubular string. The indicator light 210 may be off during manual operation of the tong 100 using the toggle lever 206. As the connection is made-up, the torque applied by the tong 100 and measured by the control system 160 may increase. Once the connection reaches the set torque, the control system 160 may send a signal to the tong control assembly 200. The indicator light 210 may provide an indication that the automatic make-up sequence can be initiated. For example, the indicator light 210 may steadily blink to provide an indication to the operator. Optionally, the control system 160 may require release and reengagement of the dead man switch 214 after reaching the set torque and before beginning the automatic make-up sequence.

In the next step of the operation, the push-button control 212 may be pressed. The push-button control 212 may send a signal from the tong control assembly 200 to the control system 160 to initiate the automatic make-up sequence. The control system 160 may control the operation of the tong 100 until the connection is fully tightened. The control system 160 may monitor the torque and/or turns of the tubulars to determine if the connection is fully tightened. The control system 160 may compare the torque and/or turns to inputs (e.g., final torque, final turns) provided by the operator and/or calculated by the control system 160 based on the thread type, size, and material of the tubulars. The indicator light 210 may be steady on during the automatic make-up sequence of the tong 100.

After finishing make-up of the connection between the tubular and the tubular string, the toggle lever 206 may be operated to release the clamping force from the tubular. Optionally, the control system 160 may require release and reengagement of the dead man switch 214 after finishing make-up of the connection and before manually operating the tong control assembly 200. The toggle lever 206 may be operated to control the tong 100. The toggle lever 206 may send a signal to the control system 160 to rotate the rotor of the jaws. Rotation of the rotor may cause the gripping members to retract outward, thereby releasing the clamping force on the tubular. The toggle lever 206 may control the rotational speed of the rotor. After releasing the clamping force on the tubular, the toggle lever 206 may be operated to rotate the rotor and align the recess of the rotor with the opening of the tong 100. Once aligned, the tong 100 may be removed from the tubular string. The above operation may be repeated to add the desired number of tubulars to the tubular string.

In some embodiments, the tong 100 may be operated to remove tubulars from a tubular string by the following steps. An operator may grasp the tong 100 by the handle 204. The handle 204 may be configured to allow the operator to move the tong 100 adjacent a string of tubulars being broken up. The operator may move the tong 100 adjacent the string of tubulars. The dead man switch 214 may be grasped and held in order to allow for operation of the tong 100 and use of the tong control assembly 200. The toggle lever 206 may be operated to align the recess in the upper jaws 115-U (the jaws may already be in this configuration following the removal of the tong 100 from a previous section of tubing) with the opening at the front of the upper jaws 115-U. The toggle lever 206 may send a signal to the control system 160 to rotate the rotor of the jaws including the recess. The operator may control the speed at which the rotor rotates using the toggle lever 206. The recess of the rotor may be aligned with the opening at the front of the jaws 115-U to allow the tubular string to be inserted into the tong 100. The tubular string is then introduced into the openings in the upper and lower jaws through the recesses and the lower tubular is clamped in position in the lower jaws 115-L.

Next, the toggle lever 206 may be operated to clamp the upper tubular in position in the upper jaws 115-U. The toggle lever 206 may send a signal to the control system 160 to rotate the rotor. The operator may control the speed at which the rotor rotates using the toggle lever 206. The operator may lower the speed at which the rotor rotates by moving the toggle lever 206 closer to the neutral position, shown in FIG. 2. The operator may increase the speed at which the rotor rotates by moving the toggle lever 206 further from the neutral position. Rotation of the rotor may cause gripping members of the upper jaws 115-U to cam inward and grip the tubular. The tong 100 may then be operated to remove the tubular from the tubular string. The operator may continue to operate the tong 100 using the toggle lever 206. The toggle lever 206 may control the rotational speed of the tubular relative to the tubular string. The toggle lever 206 may be operated until the connection between the upper tubular and the tubular string is broken-out.

After finishing break-out of the connection between the tubular and the tubular string, the toggle lever 206 may be operated to release the clamping force from the tubular. Optionally, the control system 160 may require release and reengagement of the dead man switch 214 after finishing break-out of the connection and before manually operating the tong control assembly 200. The toggle lever 206 may be operated to control the tong 100. The toggle lever 206 may send a signal to the control system 160 to rotate the rotor. Rotation of the rotor may cause the gripping members to retract outward, thereby releasing the clamping force on the tubular. The toggle lever 206 may control the rotational speed of the rotor. After releasing the clamping force on the tubular, the toggle lever 206 may be operated to rotate the rotor and align the recess of the rotor with the opening of the tong 100. Once aligned, the tong 100 may be removed from the tubular and the tubular string. The above operation may be repeated to remove the desired number of tubulars from the tubular string.

Conventional tongs may be retrofitted with one or more embodiments of the tong control assembly.

In one or more of the embodiments described herein, a tong includes a frame having jaws configured to engage a tubular, a tong control assembly disposed on the frame, the tong control assembly including a toggle lever configured to control a rotational speed of the jaws.

In one or more of the embodiments described herein, the tong control assembly further includes a housing connected to the frame of the tong.

In one or more of the embodiments described herein, wherein the toggle lever is movable through a continuous range of rotational speeds.

In one or more of the embodiments described herein, the toggle lever is configured to control a continuous range of rotational speeds of the jaws.

In one or more of the embodiments described herein, wherein the toggle lever is pivotally movable.

In one or more of the embodiments described herein, wherein the toggle lever is configured to rotate the jaws bi-directionally.

In one or more of the embodiments described herein, wherein the toggle lever is configured to control a rotational speed of a tubular engaged by the jaws.

In one or more of the embodiments described herein, the tong control assembly further includes a handle connected to the housing, a shutoff switch, an indicator light, and a push-button.

In one or more of the embodiments described herein, the shutoff switch, the indicator light, and the push-button disposed on the handle.

In one or more of the embodiments described herein, the indicator light configured to indicate an operational mode of the tong.

In one or more of the embodiments described herein, wherein the push-button is configured to initiate an automatic make-up sequence of the tong.

In one or more of the embodiments described herein, wherein the shutoff switch is configured to be depressed to operate the tong control assembly.

In one or more of the embodiments described herein, wherein the toggle lever is located at a suitable position on the housing, whereby the toggle lever is configured to be operated while the shutoff switch is depressed.

In one or more of the embodiments described herein, a tong includes a frame having first jaws configured to engage a tubular, a tong control assembly disposed on the frame, the tong control assembly including a housing connected to the frame, a handle connected to the housing, a shutoff switch, and a toggle lever configured to control a rotational speed of the first jaws, wherein the toggle lever is located at a suitable position on the housing, whereby the toggle lever is configured to be operated while the shutoff switch is depressed.

In one or more of the embodiments described herein, a method of operating a tong includes clamping a first tubular using first jaws of the tong, clamping a second tubular using second jaws of the tong, rotating the first tubular relative to the second tubular, controlling a rotational speed of the first tubular using a toggle lever disposed on a frame of the tong.

In one or more of the embodiments described herein, the method further includes while controlling the rotational speed of the first tubular, connecting the first tubular and the second tubular.

In one or more of the embodiments described herein, the method further includes while controlling the rotational speed of the first tubular, breaking a connection between the first tubular and the second tubular.

In one or more of the embodiments described herein, the method further includes controlling the rotational speed of the first tubular to reach a set torque.

In one or more of the embodiments described herein, the method further includes initiating an automatic connection sequence after reaching the set torque In one or more of the embodiments described herein, the method further includes while controlling a rotational speed of the first tubular, depressing a shutoff switch of a tong control assembly disposed on the tong.

In one or more of the embodiments described herein, wherein controlling the rotational speed of the first tubular comprises pivotally moving the toggle lever.

In one or more of the embodiments described herein, a method includes installing a tong control assembly on a frame of a tong, the tong control assembly including a toggle lever and controlling a rotational speed of the first jaws using the toggle lever.

In one or more of the embodiments described herein, a tong includes a frame having a first jaws configured to engage a tubular, a tong control assembly disposed on the frame. The tong control assembly includes a housing connected to the frame, a shutoff switch, and a toggle lever located at a suitable position on the housing, whereby the toggle lever is configured to be operated while the shutoff switch is depressed, and wherein the toggle lever is configured to control at least one of: a rotational speed of the first jaws and a rotational direction of the first jaws.

In one or more of the embodiments described herein, a tong includes a frame having a first jaws configured to engage a tubular, a tong control assembly disposed on the frame including a housing connected to the frame, a handle connected to the housing, and a toggle lever configured to control a rotational speed and a rotational direction of the first jaws.

In one or more of the embodiments described herein, the toggle lever is configured to control a rotational speed and a rotational direction of a tubular engaged by the first jaws.

While the foregoing is directed to embodiments of the present invention, other and further embodiments of the invention may be devised without departing from the basic scope thereof, and the scope thereof is determined by the claims that follow.

The invention claimed is:

1. A control assembly for controlling a tubular handling apparatus, comprising:

a housing including a recessed portion configured to receive at least a portion of a single hand;

a handle connected to the housing; and a toggle lever configured to control the tubular handling apparatus;

wherein the handle and the toggle lever are positioned such that the single hand can grasp the handle and operate the toggle lever.

2. The control assembly of claim 1, wherein the toggle lever is pivotally connected to the housing.

3. The control assembly of claim 1, further comprising a shutoff switch, wherein the shutoff switch is positioned such that the single hand can operate the shutoff switch and the toggle lever together.

4. The control assembly of claim 3, wherein the shutoff switch includes:

an actuation plate configured to be engaged by the single hand and moved from a neutral position to a depressed position;

one or more biasing members disposed in the handle configured to bias the actuation plate towards the neutral position; and one or more push-buttons disposed in the handle, wherein the actuation plate is configured to depress the one or more push-buttons in the depressed position.

5. The control assembly of claim 1, wherein the toggle lever is disposed on the handle.

6. The control assembly of claim 1, further comprising a push-button control, wherein the push-button control is positioned such that the single hand can depress the push-button control.

7. The control assembly of claim 1, further comprising an electrical connector configured to transfer one or more signals between the control assembly and the tubular handling apparatus.

8. The control assembly of claim 1, wherein the toggle lever is pivotable in a first direction to control a first range of rotational speeds of the tubular handling apparatus in a first rotational direction of the tubular handling apparatus.

9. The control assembly of claim 8, wherein the toggle lever is pivotable in a second direction to control a second range of rotational speeds of the tubular handling apparatus in a second rotational direction of the tubular handling apparatus.

10. The control assembly of claim 1, wherein the housing includes a first shoulder and a second shoulder, wherein the recessed portion is disposed longitudinally between the first shoulder and the second shoulder, and wherein the toggle lever is at least partially disposed in the recessed portion.

11. A control assembly, comprising:

a housing mountable to a tubular handling apparatus;

a handle connected to the housing; and a toggle lever configured to control at least one of a rotational speed or a rotational direction of the tubular handling apparatus;

wherein the handle and the toggle lever are positioned such that a single hand can grasp the handle and operate the toggle lever.

12. The control assembly of claim 11, wherein the toggle lever is configured to control the rotational speed and the rotational direction of the tubular handling apparatus.

13. The control assembly of claim 11, further comprising:

a shutoff switch positioned such that the single hand can activate the shutoff switch, the shutoff switch configured to allow the operation of the tubular handling apparatus when activated.

14. The control assembly of claim 13, further comprising:

a push-button control positioned such that the single hand can activate the push-button control.

15. The control assembly of claim 11, wherein the toggle lever is configured to control a range of rotational speeds of the tubular handling apparatus.

16. A method of operating a tubular handling apparatus, comprising:

grasping, with a single hand, a handle of a control assembly, the control assembly further including a toggle lever configured to control the tubular handling apparatus; and operating, with the single hand, the toggle lever of the control assembly to cause the tubular handling apparatus to rotate a tubular, wherein the toggle lever is positioned such that the single hand can operate the toggle lever and grasp the handle of the control assembly.

17. The control assembly of claim 11, wherein the housing includes a recessed portion configured to receive at least a portion of the single hand.

18. The method of claim 16, further comprising:

prior to and during the operating of the toggle lever, operating a shutoff switch of the control assembly with the single hand.

19. The method of claim 16, further comprising:

operating a push-button control of the control assembly with the single hand.

20. The method of claim 16, further comprising:

prior to the grasping of the handle and prior to the operating of the toggle lever, electrically connecting the control assembly to the tubular handling apparatus.

21. The method of claim 16, further comprising:

grasping the handle and operating the toggle lever while the control assembly is attached to the tubular handling apparatus.

22. A control assembly for controlling a tubular handling apparatus, comprising:

a housing;

a handle connected to the housing;

a toggle lever configured to control the tubular handling apparatus; and a shutoff switch, wherein the shutoff switch includes:

an actuation plate configured to be engaged by a single hand and moved from a neutral position to a depressed position;

one or more biasing members disposed in the handle configured to bias the actuation plate towards the neutral position; and one or more push-buttons disposed in the handle, wherein the actuation plate is configured to depress the one or more push-buttons in the depressed position;

wherein the handle and the toggle lever are positioned such that the single hand can grasp the handle and operate the toggle lever, and wherein the shutoff switch is positioned such that the single hand can operate the shutoff switch and the toggle lever together.

* * * * *